US006966555B2

(12) United States Patent
Cost et al.

(10) Patent No.: US 6,966,555 B2
(45) Date of Patent: Nov. 22, 2005

(54) SHEET STACKING APPARATUS

(75) Inventors: Evan John Cost, Audubon, PA (US); Jerome Daout, Nyon (CH)

(73) Assignee: Mars Incorporated, McLean, VA (US)

( * ) Notice: Subject to any disclaimer, the term of this patent is extended or adjusted under 35 U.S.C. 154(b) by 226 days.

(21) Appl. No.: 10/330,820

(22) Filed: Dec. 27, 2002

(65) Prior Publication Data

US 2003/0127791 A1 Jul. 10, 2003

(30) Foreign Application Priority Data

Dec. 28, 2001 (EP) ..... 01310940

(51) Int. Cl.[7] ..... B65H 29/26
(52) U.S. Cl. ..... 271/180; 271/177; 271/219
(58) Field of Search ..... 271/177, 188, 271/180, 181, 219

(56) References Cited

U.S. PATENT DOCUMENTS

| | | | | |
|---|---|---|---|---|
| 4,765,607 | A | | 8/1988 | Zouzoulas |
| 4,784,274 | A | | 11/1988 | Mori et al. |
| 4,807,736 | A | | 2/1989 | Kondo et al. |
| 4,809,966 | A | | 3/1989 | Kobayashi et al. |
| 4,809,967 | A | | 3/1989 | Kondo |
| 4,834,230 | A | | 5/1989 | Kondo et al. |
| 5,014,857 | A | | 5/1991 | Kondo |
| 5,344,135 | A | | 9/1994 | Isobe et al. |
| 5,419,423 | A | | 5/1995 | Ishida et al. |
| 5,421,443 | A | | 6/1995 | Hatamachi et al. |
| 5,676,366 | A | * | 10/1997 | Polidoro ..... 271/176 |
| 6,244,589 | B1 | | 6/2001 | Gerlier |
| 6,543,763 | B2 | * | 4/2003 | Ito et al. ..... 271/178 |
| 6,712,352 | B2 | * | 3/2004 | Bergeron et al. ..... 271/180 |
| 2002/0060405 | A1 | * | 5/2002 | Iwai et al. ..... 271/177 |

FOREIGN PATENT DOCUMENTS

| | | |
|---|---|---|
| EP | 0 751 487 A1 | 1/1997 |
| JP | 53 032 097 | 3/1978 |
| JP | 60 242 142 | 12/1985 |
| JP | 61 055 037 | 3/1986 |
| JP | 52 104 197 | 9/1997 |
| JP | 2000-11234 | 1/2000 |

* cited by examiner

*Primary Examiner*—Donald P. Walsh
*Assistant Examiner*—Kaitlin Joerger
(74) *Attorney, Agent, or Firm*—Fish & Richardson P.C.

(57) ABSTRACT

A banknote stacker comprising at least one first scissors linkage acting to extend a pusher into a cashbox, and at least one second scissors linkage acting transversely to said first to extend a lateral portion of said pusher to flatten a note in the cashbox.

11 Claims, 14 Drawing Sheets

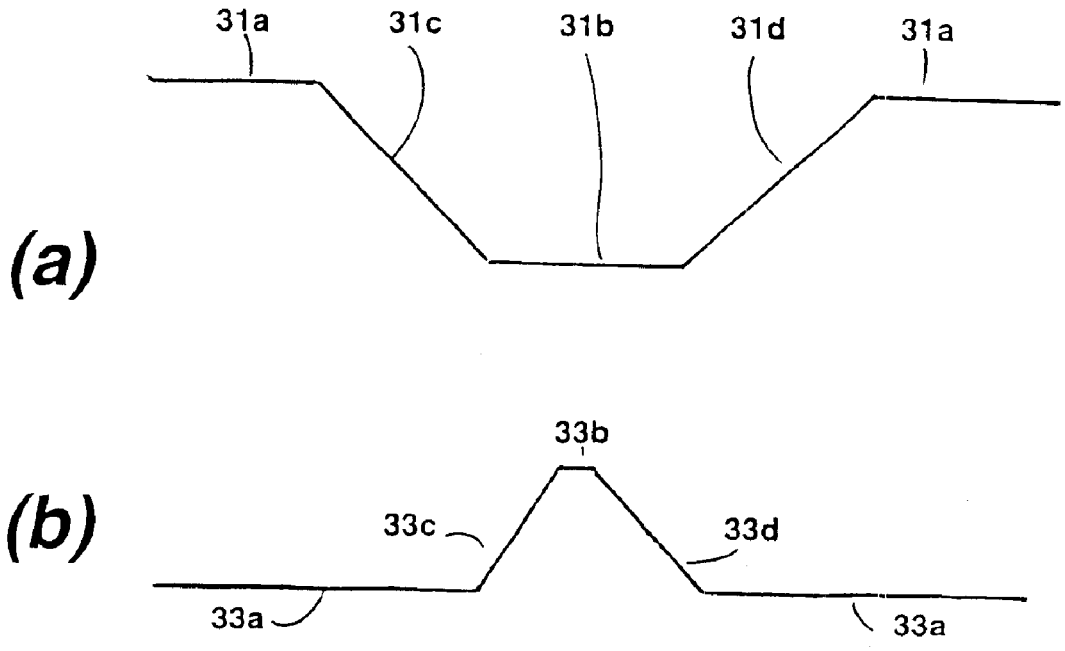
FIG. 7
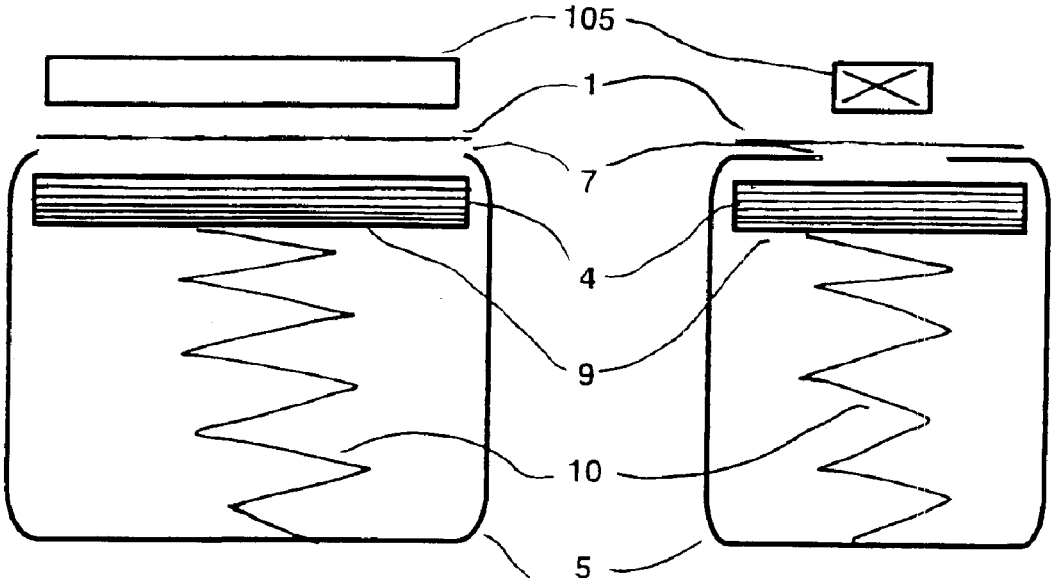
FIG. 8a
FIG. 8b

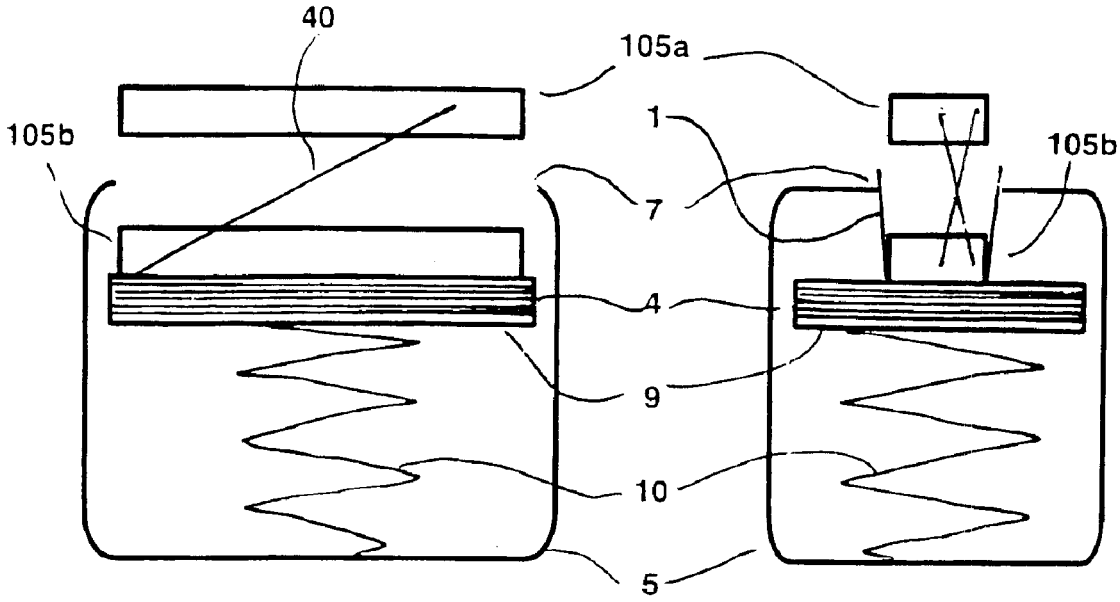
FIG. 9a
FIG. 9b
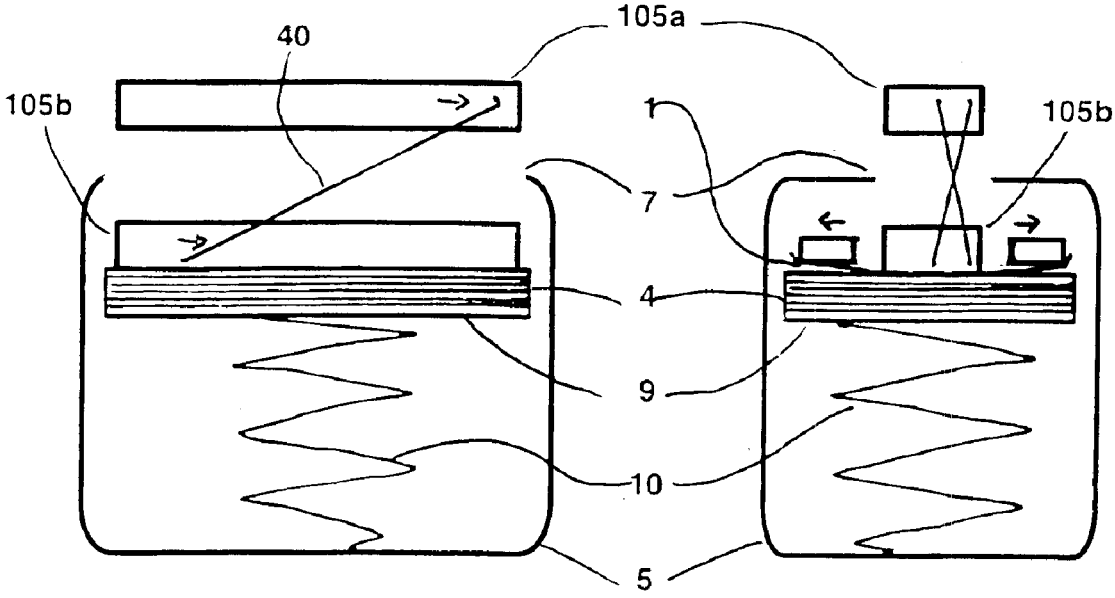
FIG. 10a
FIG. 10b

SHEET STACKING APPARATUS

FIELD OF THE INVENTION

This invention relates to an apparatus for forming a stack of sheet-like objects, in particular but not exclusively a stack of banknotes formed in a cashbox.

BACKGROUND ART

Various devices are known for forming stacks of banknotes. One such device is described in published European patent application No. 0684929. This discloses an apparatus which incorporates a pusher plate with which a banknote may be pushed from the plane along which the banknote is transported to the stacking mechanism (transport plane), into a cashbox situated adjacent to the banknote plane. The pusher plate is connected by a pivoted lever arrangement via a cam, to a drive motor. The pivoted lever arrangement operates with a "scissors action" to cause the pusher plate to push the banknote into the cashbox against the action of a spring mounted stack surface. The banknotes are retained in a stack in the cashbox, when the pusher plate is withdrawn, by flanges which abut the ends of the uppermost surface of the banknote stack.

Other stackers with a vertical scissors arrangement driving a pusher are disclosed in U.S. Pat. No. 4,807,736, EP 0751487, U.S. Pat. No. 4,809,966, U.S. Pat. No. 5,344,135, U.S. Pat. No. 5,421,443, U.S. Pat. No. 4,765,607, U.S. Pat. No. 5,419,423, and U.S. Pat. No. 4,784,274.

Although this type of arrangement provides an efficient method of stacking banknotes, the required depth of stroke of the pusher plate is linked to the size of the aperture through which the banknote is pushed. Thus, a short depth of stroke is only possible if the aperture is relatively large. However, cashboxes with relatively large apertures suffer from the disadvantage of being difficult to make secure (i.e. self closing) on detachment from the stacking device. Also, where the cashbox is used with multiple denominations of notes (having different widths), the aperture must be significantly shorter than the width of the shortest banknote to be stacked. This is in order that the flanges at the ends of the aperture may retain even the shortest banknotes. This results in a minimum length of pusher plate stroke being further increased in order to successfully stack the widest banknotes through the same aperture size and hence a corresponding increase in the depth of the cashbox.

The cashbox aperture may be made smaller by increasing the depth of stroke of the pusher plate. However, an increased depth of stroke results in an increased cashbox depth for any given size of banknote stack. As space is often at a premium in such circumstances, for example in combined banknote validator and stacker devices, this too is an undesirable consequence.

U.S. Pat. No. 4,809,967 and U.S. Pat. No. 5,014,857 disclose a stacking device of the piston type which aims to address the problem of ensuring that banknotes flatten correctly on the stack surface during the stacking process. These disclosures teach to incorporate pivotally mounted "unfolding" plates in the piston assembly. These are arranged to displace horizontally as the piston stroke increases in the vertical direction; thus assisting in flattening a banknote against the stack.

However, despite assisting with flattening banknotes in the stacking procedure the device of U.S. Pat. No. 4,809,967 and U.S. Pat. No. 5,014,857 suffers from the same drawback as that of EP 0684929A, in that a short depth if stroke is only possible of the cashbox aperture is relatively large; or, conversely a small aperture is only achievable if the stroke length is relatively long.

U.S. Pat. No. 6,244,589 shows a stacker which is arranged to stack through a relatively narrow aperture (thus providing enhanced security) with a relatively short stroke (thus making efficient use of cashbox volume), using, in one embodiment, a pair of rotor arms.

SUMMARY OF THE INVENTION

The present invention is intended to provide a stacker capable of operating through a narrow aperture, with a short stroke, and having a compact construction. These objects, separately or together, are achieved by the aspects of the invention defined in the claims.

Other aspects and embodiments of the invention, with corresponding objects and advantages, will be apparent from the following description and claims.

The invention will now be illustrated, by way of example only, with reference to the accompanying drawings, in which:

BRIEF DESCRIPTION OF THE DRAWINGS

FIG. 7 (comprising FIG. 7*a* and FIG. 7*b*) shows schematically the cam tracks of two cams of FIG. 3 when projected onto a flat surface;

FIG. 8*a* is a schematic sectional side elevation (along the length of the banknote path) showing the stacker in an initial position; and FIG. 8*b* is a corresponding sectional end elevation (across the banknote path) in the initial position;

FIGS. 9*a* and 9*b* correspond to FIGS. 8*a* and 8*b* in a second stage of the stacker stroke;

FIGS. 10*a* and 10*b* correspond to FIGS. 8*a* and 8*b* in a third stage of the stacker stroke in which the stacker is fully extended;

DETAILED DESCRIPTION

First Embodiment

Figure 1:
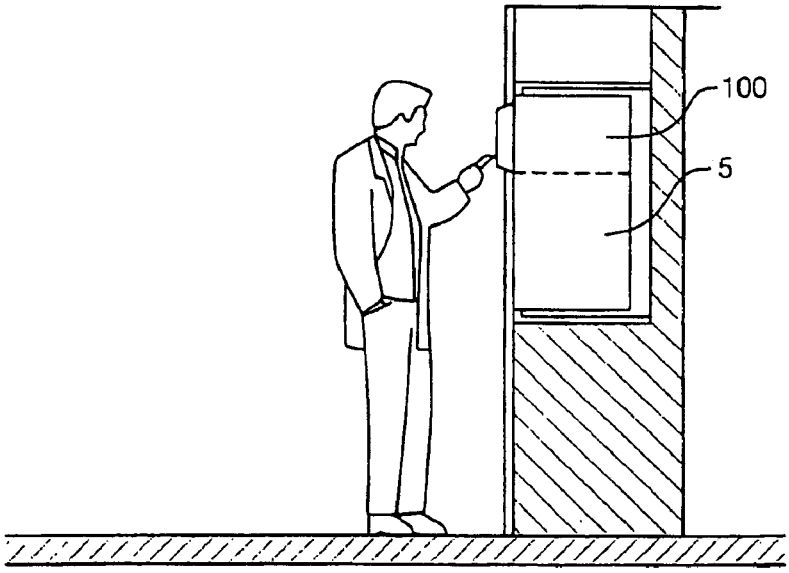
FIG. 1 illustrates a banknote handling machine including a cashbox with which a stacking mechanism according to the present invention may be used.
Figure 2:
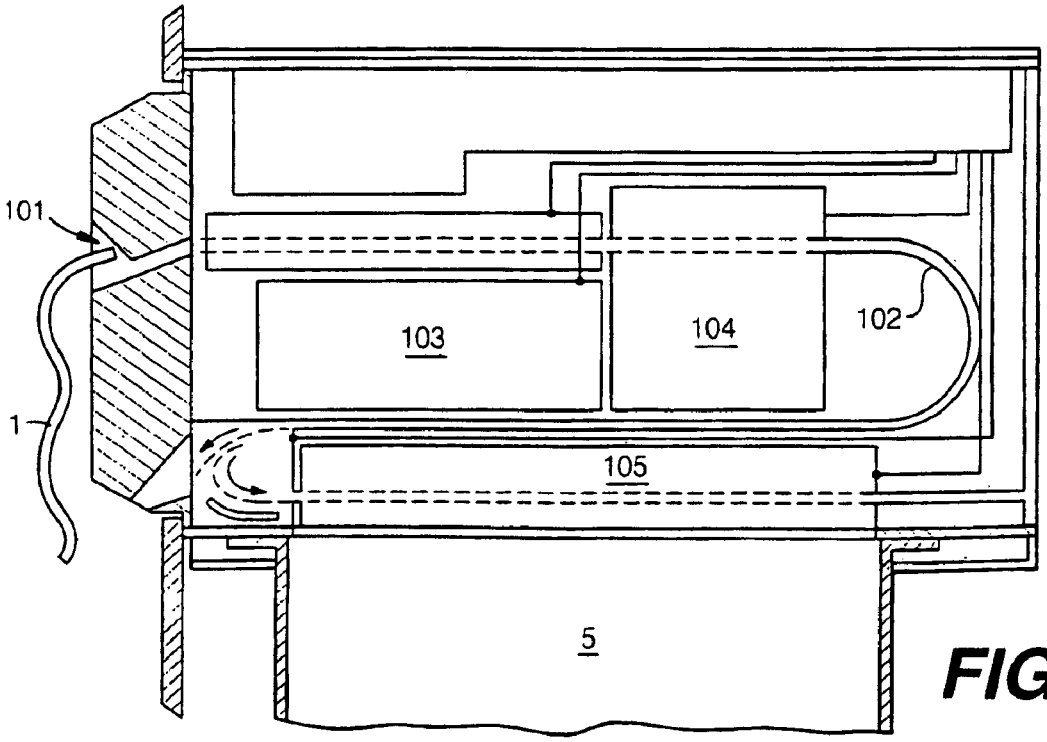
FIG. 2 illustrates a sectional view through a portion of FIG. 1.

Referring to FIGS. 1 and 2, a banknote stacking system according to the first embodiment of the invention is shown. The system comprises a banknote transport system, a stacking mechanism and a cashbox 5. The stacking mechanism and the transportation mechanism are housed in a banknote handling apparatus, such as a validator, to which a cashbox 5 is removably attached.

Referring to FIG. 1, a banknote validating machine 100 is shown in conjunction with a cashbox 5. Referring now to FIG. 2, an idealised sectional view through the machine 100 is shown. This shows a banknote 1 on the point of being inserted into an aperture 101 from where it is transported along a banknote transportation system 102 by a drive unit 103 and validated by a validation apparatus 104. The transportation system 102 then transports the banknote 1 to a stacking arrangement 105 so that the banknote 1 may be stacked in the cashbox 5 as will be described. The stacking arrangement 105 may be located in the validator 100 as it is shown in FIG. 2 or alternatively in the cashbox 5 itself Banknote Transport System A banknote 1 is transported to the stacking mechanism in a direction perpendicular to the plane of the diagram by the transportation mechanism, which comprises opposing pairs of rollers 2*a*, 2*b* and 3*a*, 3*b*. The banknote 1 is engaged by transportation rollers 2*a*, 2*b*, 3*a*, 3*b* parallel to its lengthwise edges. That is to say it is transported in the direction of its longitudinal axis. The spacing between the pairs of rollers 2*a*, 2*b* and 3*a*, 3*b* is arranged such that even the minimum size of banknote for which the mechanism is designed may be securely held and transported.

The rollers 2*a*, 2*b*, 3*a*, 3*b* position the banknote 1 above an aperture 7 of the cashbox 5. In this embodiment, the aperture 7 is approximately half of the width of the banknote; i.e. approximately 37 mm across. This is suitable for banknote widths of 62–85 mm. The position of the leading edge of the banknote 1 is sensed using photosensors (not shown), or other suitable position sensing devices, which are occluded by the banknote 1 when it is in the correct position. The output from the photosensors is then used to inhibit further transport of the banknote 1.

The rollers 2*a*, 2*b*, 3*a*, 3*b* are located on either side of the aperture 7, such that he banknote 1 is gripped with a positive force and held flat and parallel to the aperture 7 prior to being stacked.

Stack Support Mechanism

Figure 6:
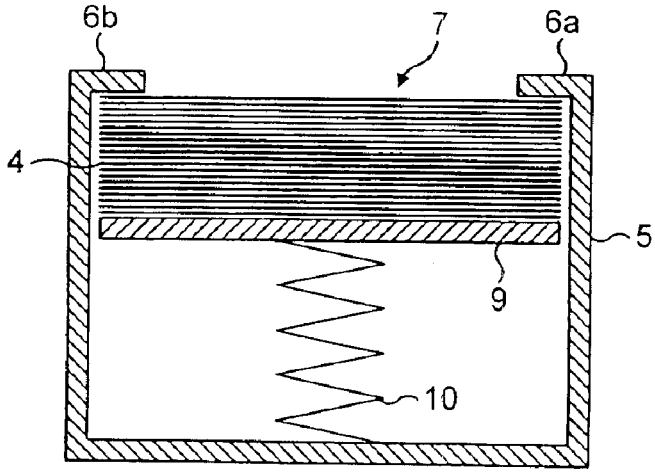
FIG. 6 is a schematic diagram showing the stack support structure of the first embodiment within the stacker.

Referring to FIG. 6, as shown schematically therein, the stack support mechanism for supporting notes in the cashbox 5 comprises a stack support surface 9 located inside the cashbox and biased towards the aperture 7 by a compression spring 10. Notes are retained in the cashbox by upper retaining walls 6*a*, 6*b* at the top of the cashbox, the edges of which define the aperture 7.

Stacking Mechanism

Figure 3A:
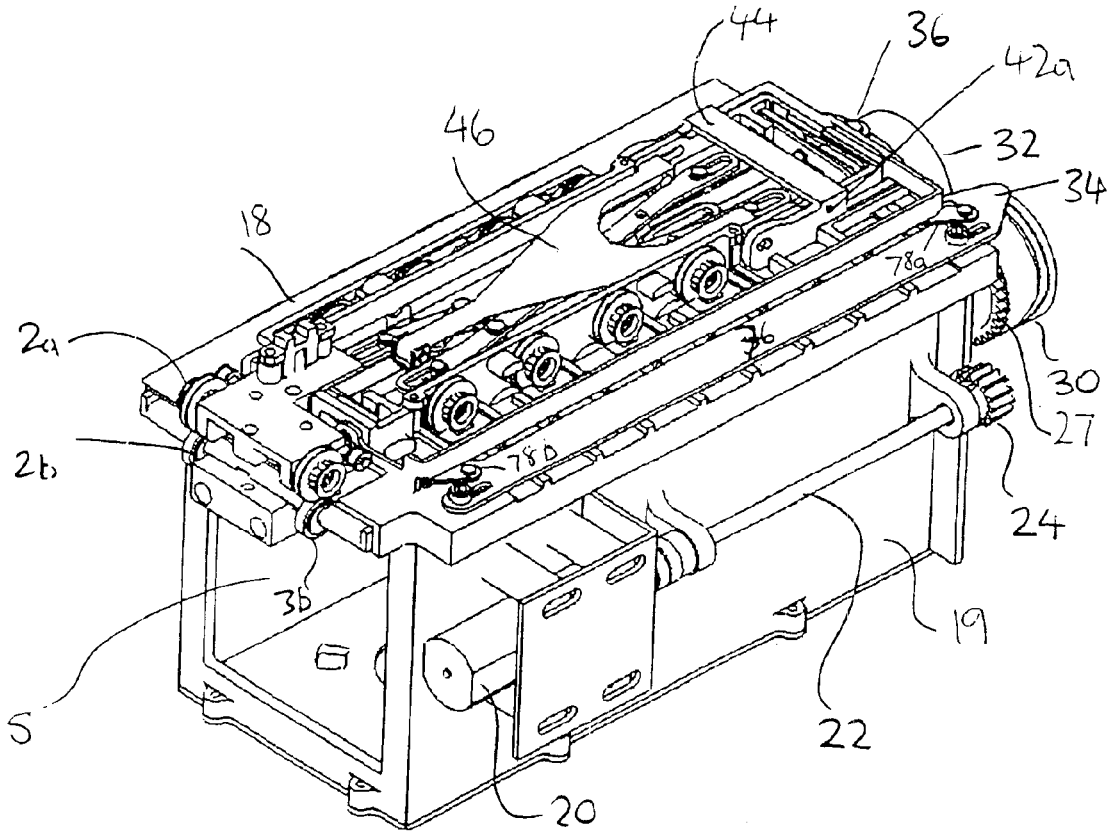
FIG. 3*a* is an isometric view of a cashbox and stacker arrangement according to a first embodiment of the invention.

Referring to FIG. 3, and in particular to FIG. 3*a*, the cashbox 5 of FIG. 6 is mounted beneath a plate 18 which carries the stacker assembly.

Mounted to an outer wall 19 of the cashbox 5 is a motor 20, the output of which is coupled to a drive shaft 22 driving a gear wheel 24 which meshes with a second gear wheel 26 which in turn meshes with a third gear wheel 28.

The gear wheels 26, 28 (which are therefore driven to rotate in opposite senses by the output gear wheel 24) respectively mesh with toothed rings 27, 29, each of which is solid and co-axial with a respectively rotary cam, 30, 32.

The cams 30, 32 each carry a similarly shaped cam surface in the form of a continuous cam track distributed around the cylindrical radius of the cams 30, 32. The track comprises a recessed groove. The tracks (projected onto a flat surface), and the corresponding timing relationships between the extension strokes of the pusher and its lateral portions, are shown in FIGS. 7*a* and 7*b* respectively.

The first cam 30 is employed to move the pusher into the cashbox 5 (as will be discussed in greater detail below). The track it carries comprises a first radial portion 31*a* distant from the body of the cashbox; a second radial portion 31*b* closer to the body of the cashbox 5; and, connecting the two radial portions, a pair of spiral portions 31*c*, 31*d* spiralling in opposite senses around the axis of the cylindrical cam.

The cam track on the second cam 32 comprises a first radial portion close to the body of the cashbox; a second radial portion (much shorter than that of the first cam) distant from the body of the cashbox 5; and, connecting the two radial portions, a pair of spiral portions spiralling in opposite senses around the axis of the cylindrical cam.

Engaging with each of the cam tracks is a respective cam follower 34, 36 which comprises a pin or peg, located above the cam bodies 30, 32, each of the pins 34, 36 being arranged to slide within its respective cam track.

Figure 3B:
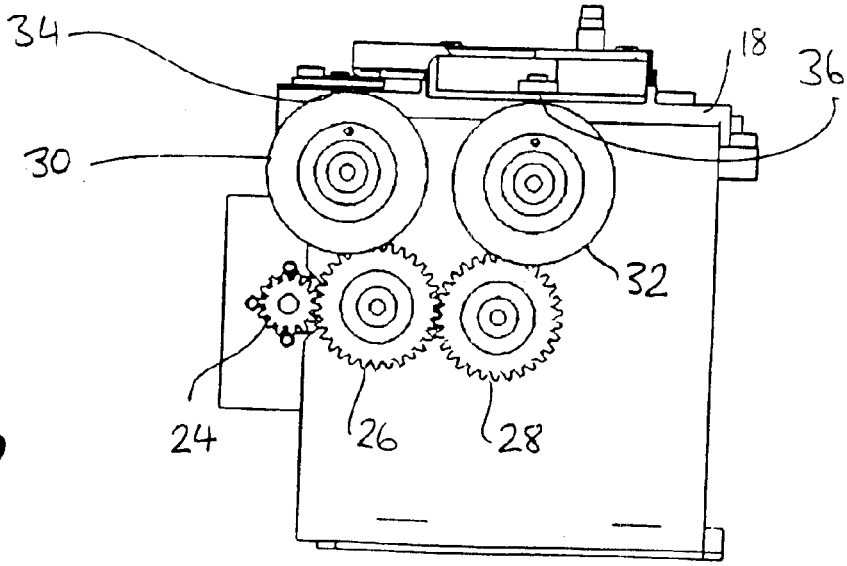
FIG. 3*b* is an end elevation showing the end not visible in FIG. 3*a;*
Figure 3C:
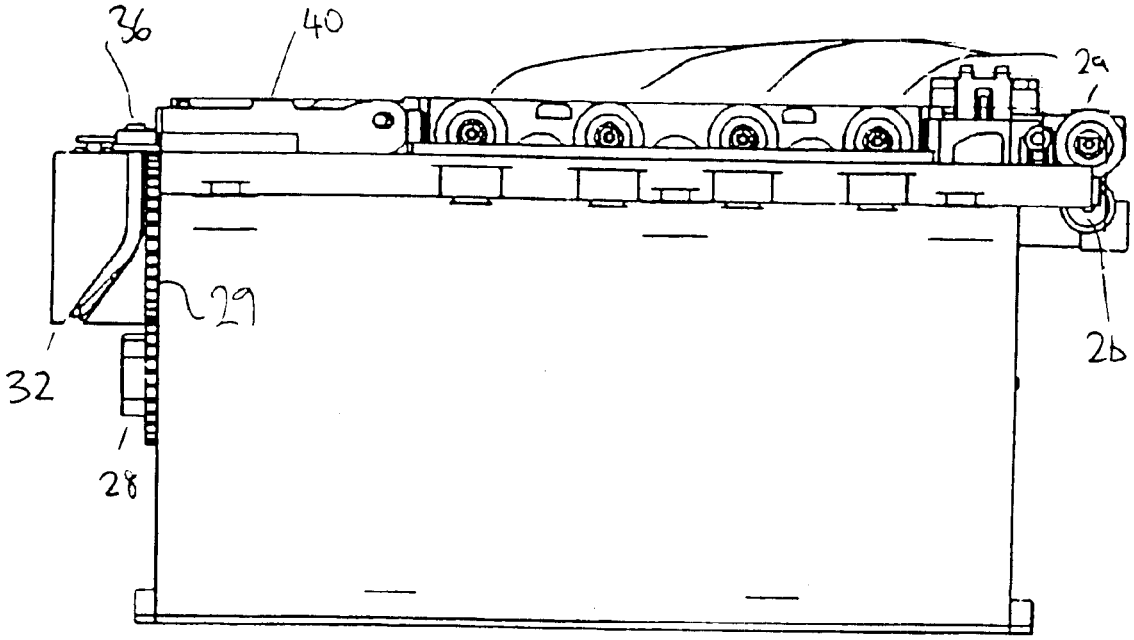
FIG. 3*c* is a side elevation showing the side not visible in FIG. 3*a*, and to the same scale as FIG. 3*b*.
Figure 3D:
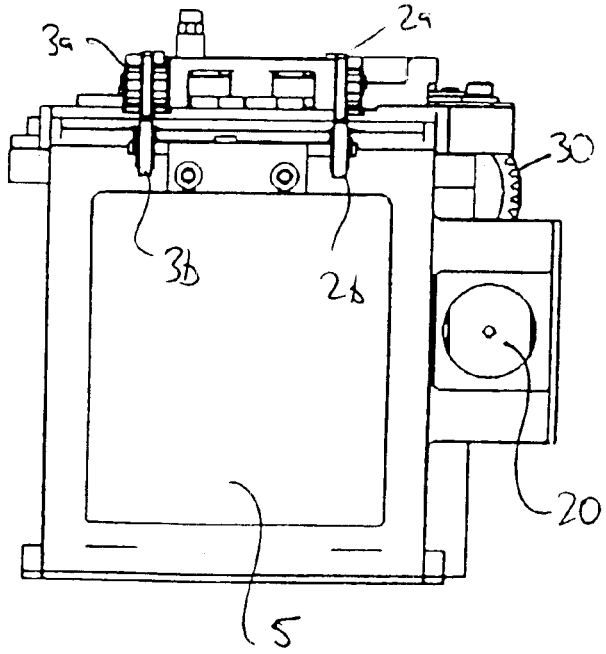
FIG. 3*d* is a further end elevation to the same scale as FIGS. 3*b* and 3*c*, showing the end visible in FIG. 3*a;*

It will be apparent from inspection of FIGS. 3*a*–3*c* that the operation of driving the motor 20 causes the cams 30, 32 to rotate in opposite senses, and that as the rotation takes place, the cam followers are displaced from their initial position (close to the cashbox 5) in which they lie within the first radial portion of the track, to an extended position as they follow the first spiral portion to the second radial portion, and then to return back to the initial position as they follow the second spiral portion back to the first radial portion.

Each stroke of the stacker is executed by causing one rotation of the cams 30, 32 (corresponding to several rotations of the drive shaft since the gears execute a reduction).

The first cam 30 will cause the pusher to be displaced into the cashbox (as described in greater detail below); to remain in the cashbox for a time corresponding to the time the cam follower 34 lies within the second radial portion of the spiral tracks; and to return out of the cashbox.

The second cam 32 drives laterally extended portions of the pusher, as will be described below in greater detail. The cam track on the second cam 32 is radially positioned (i.e. positioned in rotational phase) relative to that on the first cam 30, such that the first and second spiral portions and second radial portion of the second cam 32 is occupy the same rotational position as the second radial portion of the first cam 30. The first radial portion of the second cam 32 therefore occupies the same radial portion as the first radial portion of the first cam and the two spiral portions thereof.

Between the pairs of rollers 2*a*, 2*b*; 3*a*, 3*b* there is a note path passing from an input opening at a first end of the cashbox (visible in FIGS. 3*a* and 3*d*) to a position in which the note directly overlies the aperture 7 in the cashbox 5.

Above the note path, and between the pairs of rollers 2*a*, 2*b*; 3*a*, 3*b*, is the stacker arrangement. The stacker arrangement comprises an upper portion 105*a* which remains above the note path, and a lower portion 105*b* which descends into the cashbox. A pair of vertically acting scissors linkages interconnects the two.

Figure 4A:
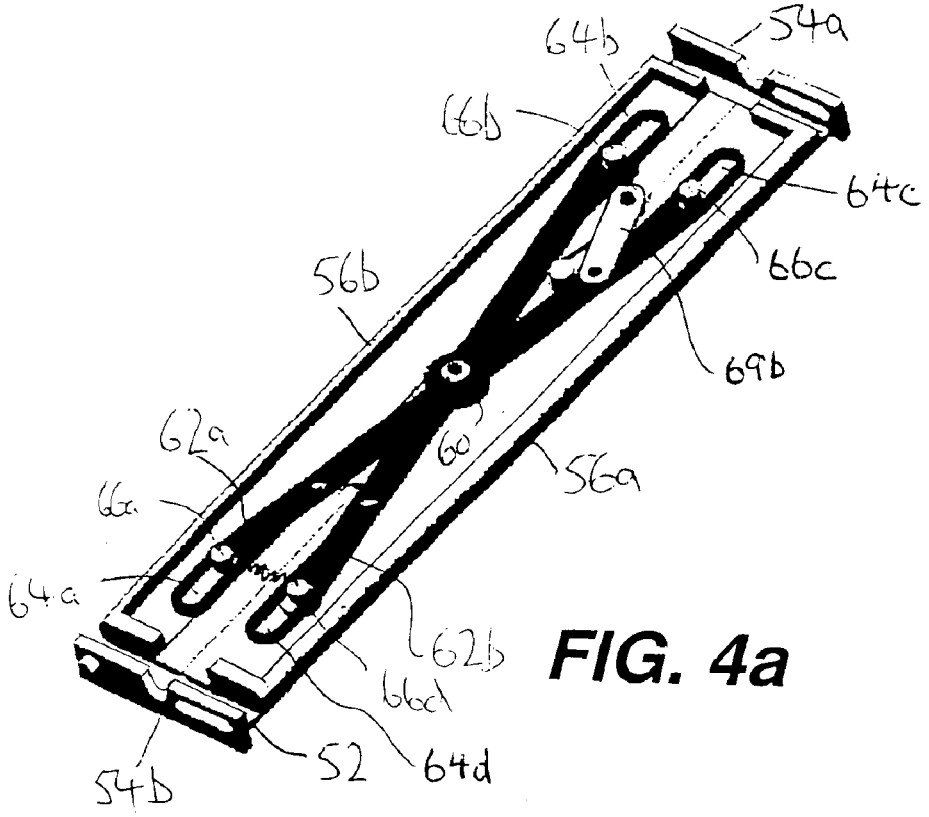
FIG. 4*a* is an isometric view of lateral elements of a pusher forming part of the first embodiment of FIGS. 3*a–d* in a retracted condition.
Figure 4B:
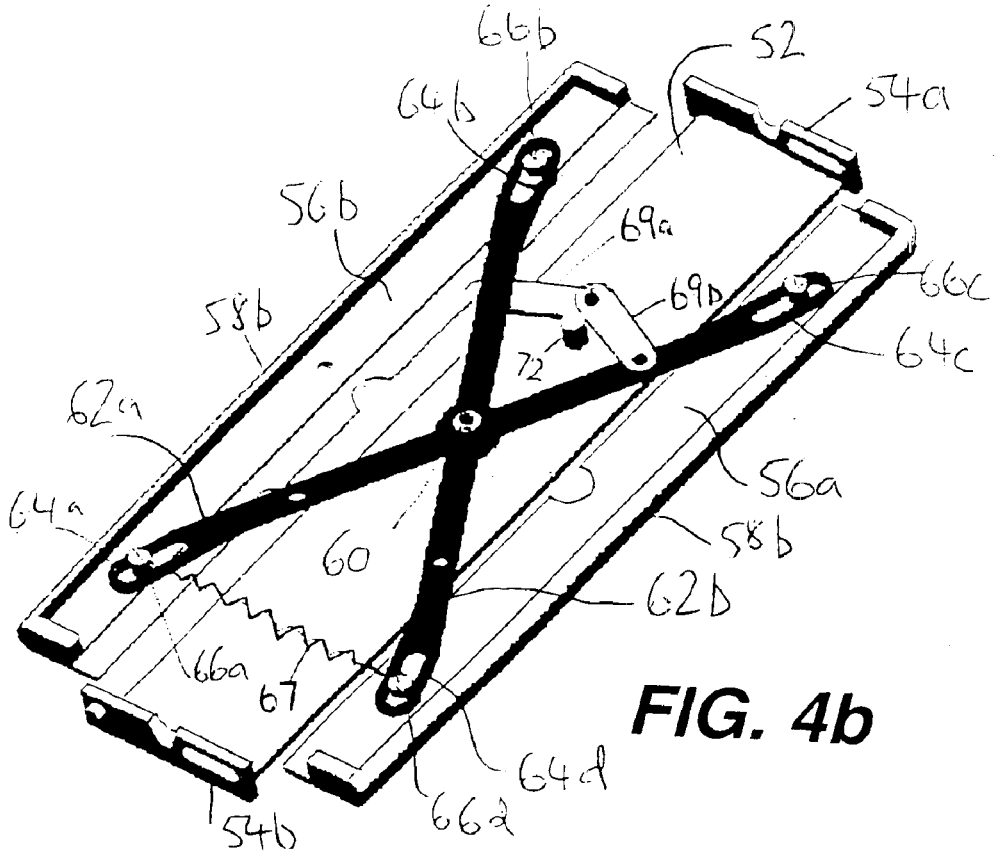
FIG. 4*b* is a corresponding isometric view of the same components in an extended condition.

Referring to FIGS. 4*a*, and 4*b*, the lower portion comprises a lower plate 52 carrying a pair of end walls 54*a*, 54*b*. The width of the lower plate and half plates in the retracted positioned is 29 mm, which is slightly less than the aperture 7 (to allow a clearance with a banknote 1 at either side).

Above the lower plate 52 is a lateral extension structure comprising a pair of half plates 56*a*, 56*b* each of lengths slightly less than the lower plate 52, and having half (or slightly less than half) the width of the lower plate 52, so that in the retracted position shown in FIG. 4*a*, the half plates 56*a*, 56*b* occupy no greater width than the lower plate 52, and sit directly above it and within the end walls 54*a*, 54*b*.

At their outer sides, the lower plates 56*a*, 56*b* carry lengthwise running shallow walls 58*a*, 58*b*; the outer edges between the lower plates 56 and their respective outer walls 58 are smoothly chamfered with a relatively large radius to allow them to move out over a banknote and smooth the note down without tearing.

At the centre of the lower plate 52, it carries an upright stub, which is mounted through the centre holes of a pair of cross arms 62*a*, 62*b* forming a horizontally-acting scissors linkage for extending the half-plates 56*a*, 56*b*.

At each end of the two arms 62*a*, 62*b* (which are symmetrical about the central stub 60) are slots 64*a*–64*d* which are slideably mounted on stubs 66*a*–66*d* carried on the half-plates 56*a*, 56*b*.

Towards one end of the half-plates 56*a*, 56*b*, a pair of the stubs 66*a*, 66*d* are interconnected by helical tension springs 67. The spring 67 operates to bias the half plates 56*a*, 56*b* together into the retracted position of FIG. 4*a*.

Towards the other end, the two arms 62*a*, 62*b* are interconnected by a linkage comprising pair of elongate links 69*a*, 69*b*, one end of which is pivotally connected to a respective arm 64*a*, 64*b*, and the other ends of which are pivotally connected together. The lower plate 52 carries a stub 72 which prevents the two links from reaching alignment in a straight line.

The two plates can be moved to the extended position of FIG. 4*b* by providing a force acting on the interconnection point between the two links 69*a*, 69*b*, in the direction of the centre stub 60 of the lower plate 52.

This will open the two plates 56*a*, 56*b* until the two links 69*a*, 69*b* impinge upon the abutment stub 72 to provide the extended position shown in FIG. 4*b*, at which the width between the edges of the half plate 56*a*, 56*b* corresponds to the width of the widest banknote to be spread onto the stack.

Figure 5A:
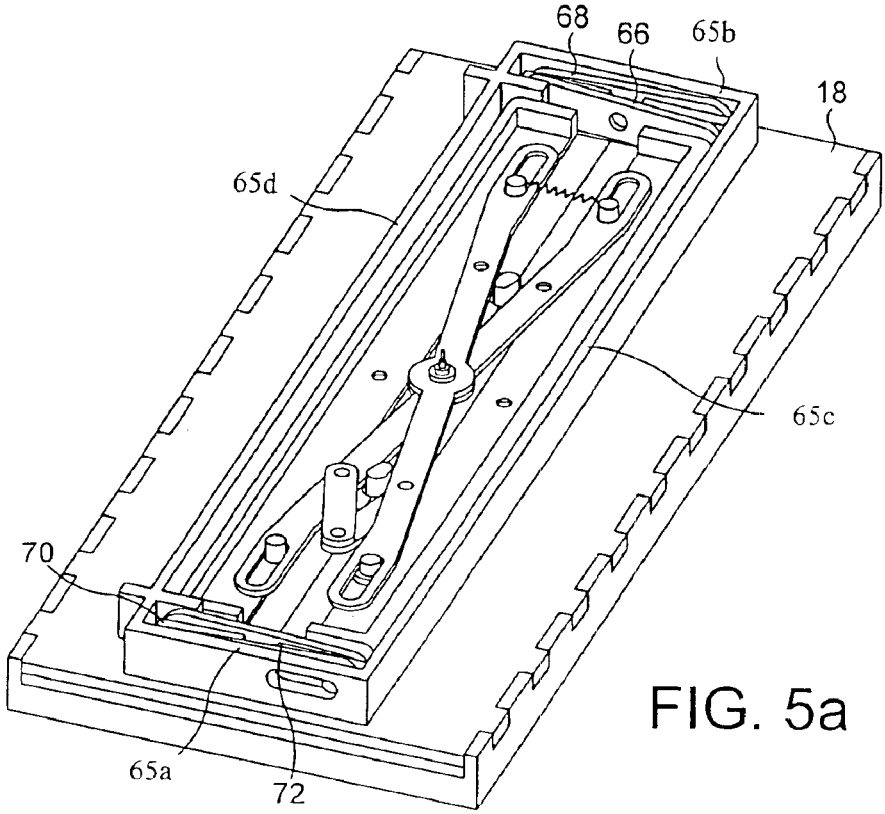
FIG. 5*a* is an isometric view showing the lateral elements of FIG. 4 within the pusher of the first embodiment in an initial state of the pusher cycle.
Figure 5B:
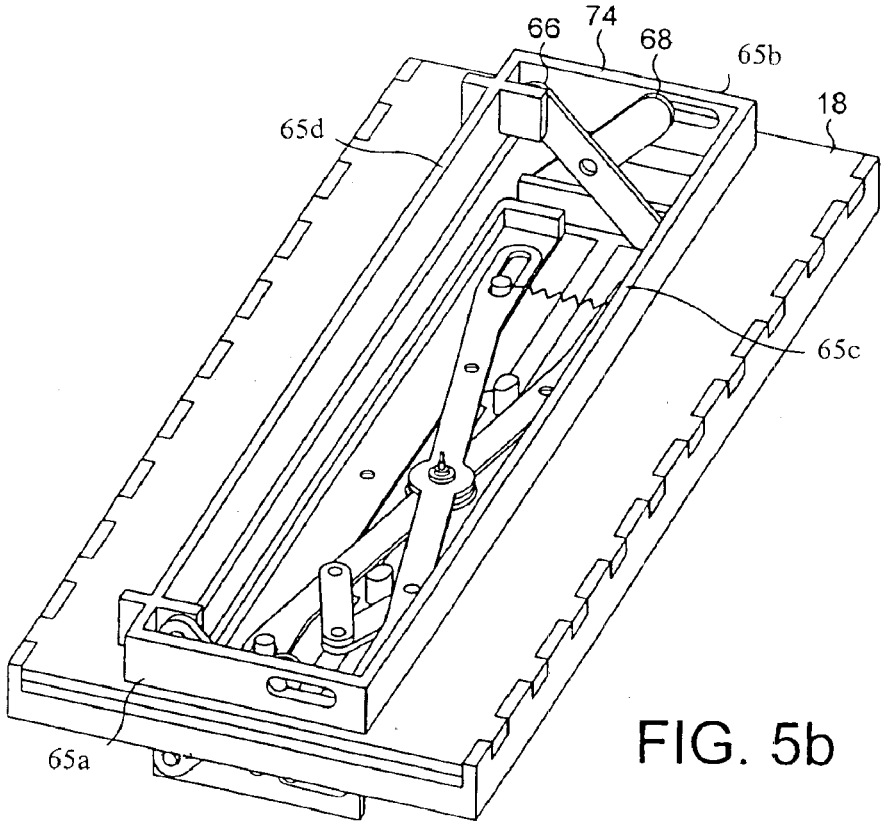
FIG. 5*b* is an isometric view showing the pusher extended to full depth with the lateral portions beginning to extend.
Figure 5C:
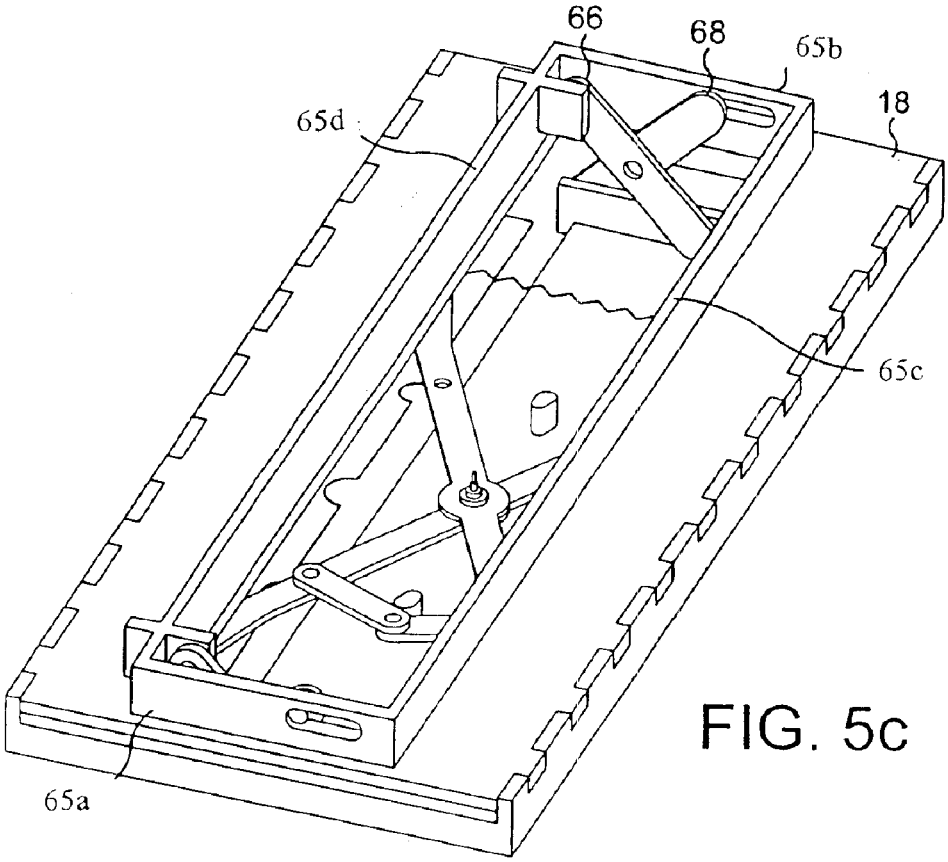
FIG. 5*c* shows the lateral portions fully extended (corresponding to FIG. 4*b*)

Referring to FIGS. 5*a*–5*c*, in which surrounding parts have been omitted for clarity, the upper plate 18 carries the upper part of the stacker in the form of a rectangular raised wall comprising upper end walls 65*a*, 65*b* and side walls 65*c*, 65*d*. In the fully etracted position of the pusher stroke, the lower portion of the pusher (shown in FIGS. 4*a* and 4*b*) is retained within the upper portion comprising the four walls 65*a*–65*d* so as to lie above the banknote plane. Lower portion end walls 54*a*, 54*b* lie just within, and aligned with, upper portion end walls 65*a*, 65*b*.

A pair of vertically acting scissor linkages interconnects the upper and lower portion end walls. The upper end of each scissor linkage is supported by one of the upper portion end walls 65*a*, 65*b* and the lower end by one of the lower portion end walls 54*a*, 54*b*.

Each of the linkages comprises a pair of arms 66, 68; 70, 72. Each pair is pivotally connected together at a centre point 74, 76. As the linkages are identical, only the linkage 66, 68 which is shown in FIG. 5 will be discussed further, it being understood that the same comments apply to the other linkage.

One end (the left hand end shown in FIGS. 5–5*c*) of each of the arms 66, 68, is connected at a pivot point at one of the upper or lower end walls, and the other carries a pin which slides in a horizontal slot in the other of the end walls. In the fully retracted position of FIG. 5*a*, the arms 66, 68, 70, 72 lie almost horizontally, with the pins at the outer ends of the slots, and in the fully extended state, shown in FIG. 5*c*, the arms extend downwards at approximately 70° from the horizontal, with the pins at the inner ends of the slots.

Referring once more to FIGS. 3*a*–3*d*, the actuation mechanisms for the scissors linkages of the stacker system will now be described.

The first cam follower 34 is connected to an elongate plate 36 running lengthwise along the note path. The movement of the first cam follower 34 longitudinally inwards of the cashbox, at the beginning of the pusher stroke, causes the elongate plate 36 to slide longitudinally, which pushes two pivoting links 78*a*, 78*b* laterally, which in turn push the upper ends of arms 68, 72 laterally in their slots, to extend the scissors linkage and extend the lower portion downwards into the cashbox.

Likewise, as the elongate plate 76 is driven back longitudinally outwards to the position shown in FIG. 3*a* at the end of the stroke, the upper ends of the arms 68, 70 are pulled back to the outer edges of the slot by the links 78*a*, 78*b*, restoring the lower portion to the initial (retracted) state of FIG. 5*a*.

The second cam follower 36 is connected to a sliding link 40 comprising a pair of side walls 42*a*, 42*b* interconnected by an upper cross bar 44. Each of the side walls 42, 42*b* carries a pin which extends inwardly through a lengthwise slot (not shown in FIGS. 5*a*–5*c*) in one of the side walls 64*c*, 64*d* of the upper portion.

Within the upper portion, interconnected the sliding link 40 with the actuating linkage 69*a*, 69*b*, is a Y shaped link 46. The ends of the two arms of the Y shaped linkage 46 are connected through the slots in the side walls 64*c*, 64*d* to the pins carried by the sliding link 44. At its other end, the leg of the Y shaped link 46 is connected to the pivot point connecting the lower portion scissors-actuating links 69*a*, 69*b*.

As shown in FIG. 3*a*, in the fully retracted position of the stacker assembly, the Y shaped link 46 lies flat on top of the arms 62*a*, 62*b* defining the horizontally-acting scissors linkage with extends the lateral portions of the stacker.

Referring to FIGS. 8 to 12, the operation of the stacker will now be described during a stacking stroke.

A banknote note 1 to be stacked is moved by the transport system comprising the pairs of rollers 2*a*, 2*b*, 3*a*, 3*b* to a position in which it overlies the aperture 7 and underlies the stacker.

As shown in FIGS. 8*a* and 8*b*, the stacker is now in the initial state shown in FIGS. 3, 4*a*, and 5*a*. The lower portion is retracted within the upper portion, and the stacker is above the banknote 1.

At this point, the control unit of the document handling system (not shown) actuates the motor 20 to start driving. This causes the cams 30, 32 to rotate. The cam follower 34 which is initially in the outer radial portion 31*a* of the track enters the first spiral portion 31*c* and consequently drives the elongate plate 76 longitudinally away from the cam 30.

This actuates the pivoted linkages 78*a*, 78*b* to act on the legs of the vertically acting scissors linkages, to extend those linkages and move the lower portion downwards into the cashbox into a position shown in FIGS. 9*a* and 9*b* and FIG. 5*b*, engaging the note stack 4. The lower leg of the Y shaped link 46 has descended with the lower portion of the stacker, and the upper arms remain within the upper portion, so that the link lies diagonally as shown in FIG. 9*a*. The central portion of the banknote 1 has been pushed into the cashbox 5 onto the stack 4, and the sides of the banknote 1 extend around the lower portion and protrude from the aperture 7.

It will be seen that the lower portion needs to descend only to a depth sufficient to allow the lateral portions to be extended beneath the upper walls 6*a*, 6*b* of the cashbox.

Having reached the second radial region 31*b* of the cam track, the cam follower 34 remains at a constant longitudinal position and the lower portion therefore remains at a constant depth within the stacker for an interval of time corresponding to the length of the second radial portion 31*b*.

At this point, however, the second cam follower 36 enters the first spiral portion 33*c* of the cam track of the second cam 32 and thus causes the sliding link 40 to be progressively displaced towards the cam 32. The sliding link 40 in turn pulls the two arms of the Y shaped link 46 laterally, which act upon the links 69*a*, 69*b* to straighten the links and force apart the arms 62*a*, 62*b* making up the horizontally-acting scissors linkage, to the position shown in FIGS. 10*a* and 10*b*, corresponding to FIGS. 4*b* and 5*c*.

The progressive displacement of the half plates 56*a*, 56*b* over the projecting sides of the banknote 1 pushes the banknote entirely through the aperture 7 and substantially flat against the stack 4 as shown in FIG. 10*b*.

Next, the cam follower 36 enters the second spiral region 33*d*, driving the sliding link 40 back, together with the Y shaped link 46, so as to release the pressure on the links 69*a*, 69*b* to allow the lower scissor arms 62*a*, 62*b* to close again under the influence of the spring 67.

Figures 11A, 11B:
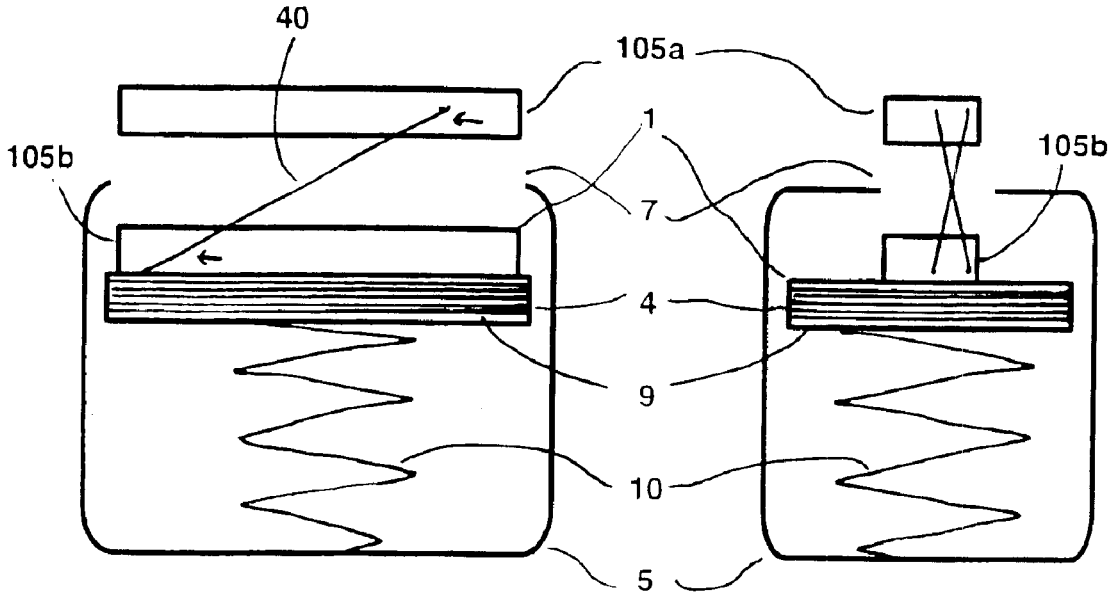
FIGS. 11*a* and 11*b* correspond to FIGS. 8*a* and 8*b* in a fourth stage of the stacker stroke.

The stacker thus reaches the position shown in FIGS. 11*a* and 11*b* (corresponding to FIGS. 4*a* and 5*b*). The note 1 now forms the top of the stack 4. The cam follower 36 re-enters the first radial region 33*a*.

Figures 12A, 12B:
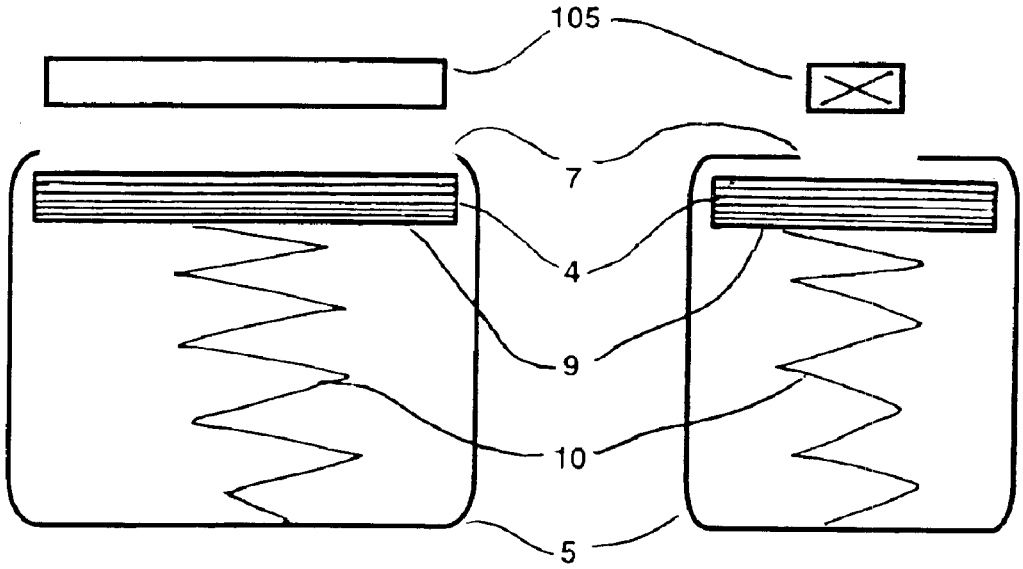
FIGS. 12*a* and 12*b* correspond to FIGS. 8*a* and 8*b* and show the stacker in a fifth and final stage of the stacker stroke.

The cam follower 34 now enters the second spiral region 31*d* of the cam track of the first cam 30, retracting the vertical scissors linkages to draw the lower portion back up inside the upper portion and out of the cashbox 5 through the aperture 7, to reach the position shown in FIGS. 12*a* and 12*b* when the cam follower 36 re-enters the first radial portion 31*a* of the first cam track.

At this point, the stacker stroke is complete, and when a further note is positioned over the aperture 7, the stacker is ready to repeat the stacker stroke.

It will be apparent from the foregoing that the above-described embodiment provides a stacker which can operate through a relatively narrow cashbox aperture 7 (providing good security) with a relatively short stroke length (making efficient use of the volume of the cashbox 5).

Furthermore, it does so using a stacker structure which occupies a very low volume above the banknote path, and consequently reduces the total size of the cash handling device into which it is fitted.

This is achieved in particular by providing that the pusher comprises a lower portion which nests into an upper portion, without connecting walls between the two, so that the maximum length of the stacker is dictated by the depth of the lower portion rather than corresponding to the maximum stroke length of the stacker.

This is further achieved by a providing a scissor linkage as the drive mechanism for vertical displacement of the stacker, since such a linkage can fold up to occupy a narrow vertical extent (corresponding to the width of the scissor arms) when retracted.

This is further achieved by providing that the laterally extending portions are driven by a horizontally acting scissors linkage (or, in more general terms, one which acts transverse to the stacking direction of the pusher and roughly parallel to the plane of the note stack and aperture).

This is substantially flat and therefore has relatively little vertical extent, but can provide a wide displacement of the lateral portions of the stacker. It will be clear that the wider the extension of the lateral portions of the stacker, the shorter is the necessary maximum length of the vertical stroke (for a given width of cashbox aperture 7).

Second Embodiment

In this embodiment, like parts are given similar reference numerals to those of the first embodiment and will not be discussed further.

Figure 14:
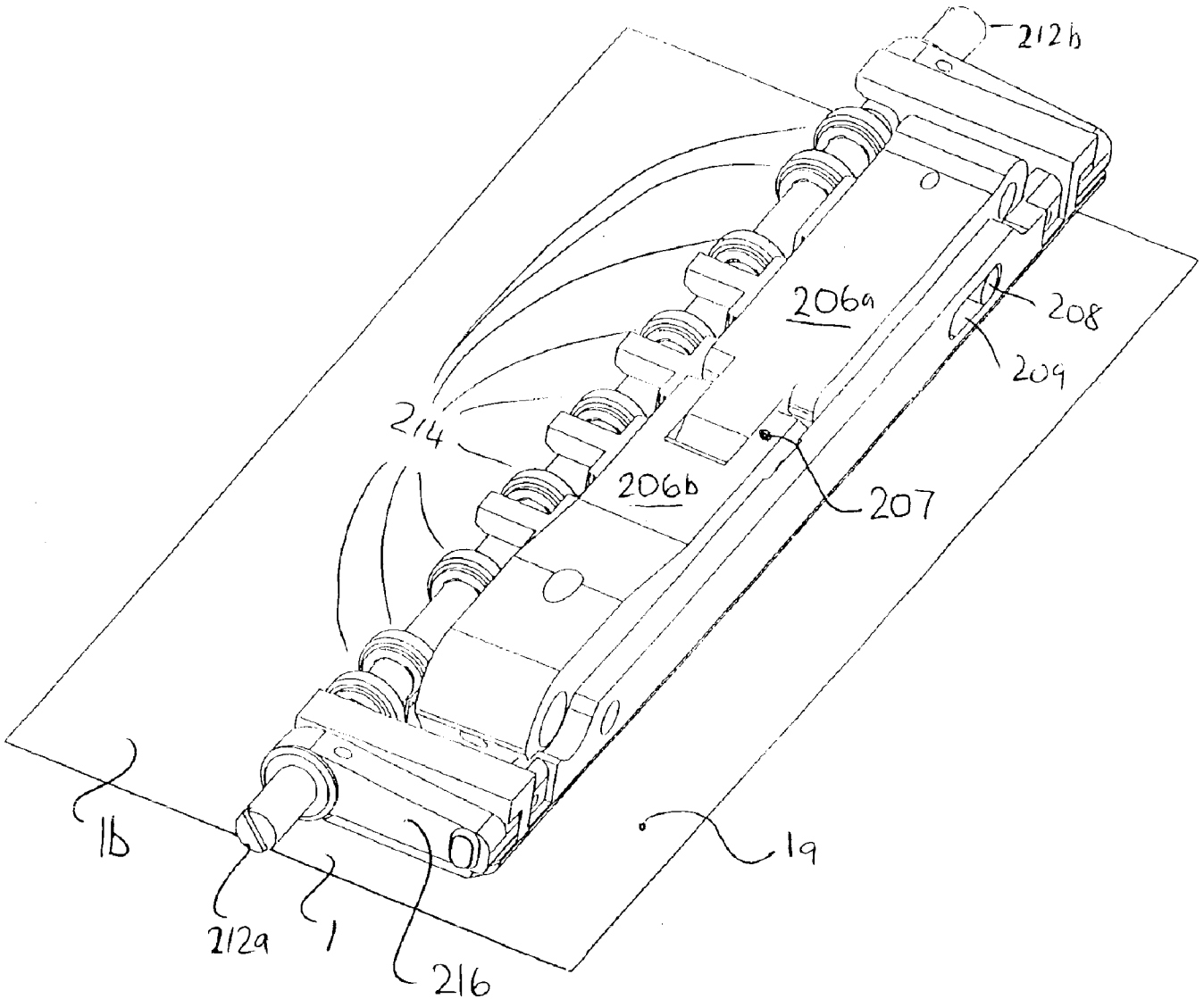
FIG. 14 is an isometric view of the piston part of the stacking mechanism of the second embodiment in a first position.

Referring to FIG. 14, the stacking arrangement 105 of this embodiment consists of two parts; a vertically operable piston portion 205 which is operated with a scissors linkage 206, and driven from above the cashbox, and a horizontally acting roller portion 210 mounted on the lower (i.e. inner) end 205*b* of the piston, which is driven by an actuator system 220 within the cashbox.

The scissors linkage 206 comprises a pair of arms 206*a*, 206*b* running lengthwise of the piston (along the length of the banknote) joined together at a pivot point 207 halfway along the arms. At their upper ends, the arms are driven together and apart in turn to create the piston extension and retraction cycle, by a cam arrangement similar to that of the first embodiment. At their lower ends, the first arm 206*a* is pivotally connected to the lower (i.e. inner) end 205*b* of the piston, and the second arm 206*b* is connected to the lower end 205*b* of the piston via a pin 208 running in a slot 209 on the piston.

Figure 15:
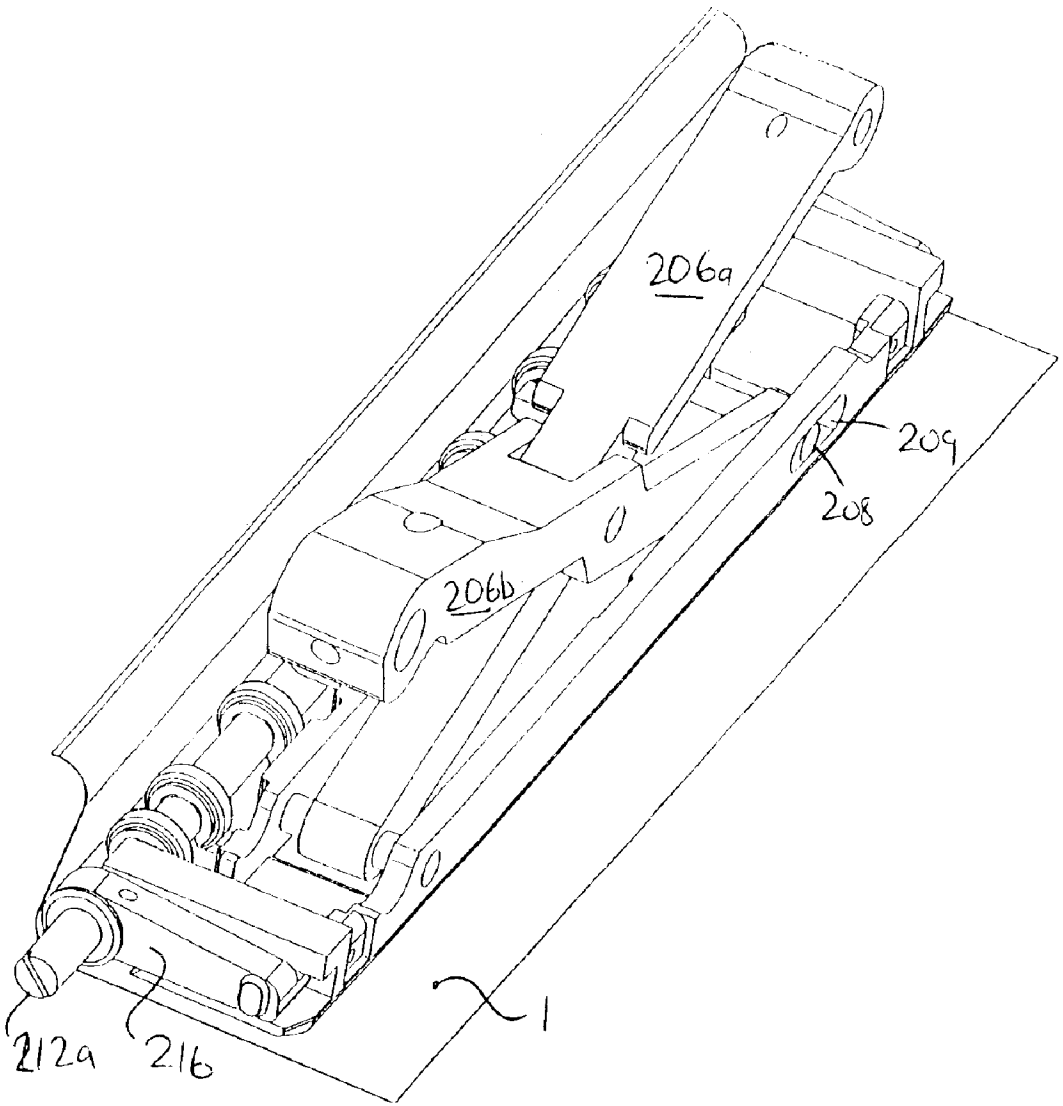
FIG. 15 corresponds to FIG. 14 and shows the piston part in a second position FIG. 16 corresponds to FIG. 14 and shows the piston part in a third position.

Referring to FIG. 15, initially a banknote 1 arrives at the stacking position, driven by rollers 2*a*, 2*b*, 3*a*, 3*b* forming part of the banknote transport system. In this initial state, the piston lies above, and closer to one side 1*a* of, the banknote 1. On the side of the piston which is further from the banknote edge, an axle 212 is mounted parallel to the length of the banknote. The axle 212 carries a set of spaced rollers 214 (214*a*, 214*b*, . . . ), on bearings allowing the rollers 214 freely to rotate around the axle.

At either end of the lower portion 205*b* of the piston, the axle 212 is supported in a sliding linkage consisting of a link 216 sliding in a slot 218. The length of the link 216 is slightly less than the width of the lower portion 205*b* of the piston. The axle 212 projects past the sliding linkage at either end.

In the cashbox, at either end wall, a rotary actuator 220 is positioned. Each rotary actuator consists of a planar member 222 having a central pivot 224, and a toothed circular arc 226 concentric with the pivot 224 which meshes with a gear wheel 228 to allow the planar member 222 to be rotated about the pivot 224 on rotation of the gear wheel 228, from a first (retracted) position through an arc to a second (extended) position.

At its upper side, the planar member 222 has an L-shaped slot 230. The slot is a little wider than the diameter of the axle, and has a first portion 232, open to the upper side, which is vertical in the retracted position. A second portion 234 of the slot connects to the first. The second portion 234 of the slot is arcuate, and concentric with the central pivot. It lies just above the maximum depth to which the stacker extends into the cashbox; in other words, just above the plane of the topmost bill in the bill stack.

With the axle in the retracted position, as shown in FIG. 14, the scissors linkage 206 is actuated to cause the lower portion 205*b* of the piston to descend into the cashbox, carrying the note 1 below it. The piston engages the bill stack, and reaches its maximum depth as shown in FIG. 15. At this stage, a portion 1*b* of the banknote 1 still extends above the surface of the cashbox, through the entry slot. In its descent, the extending ends 212*a*, 212*b* of the axle 212 descend into the first portion 232 of the slots of the actuator 220, and reach the second, arcuate portion 234 of the slots.

Figure 13:
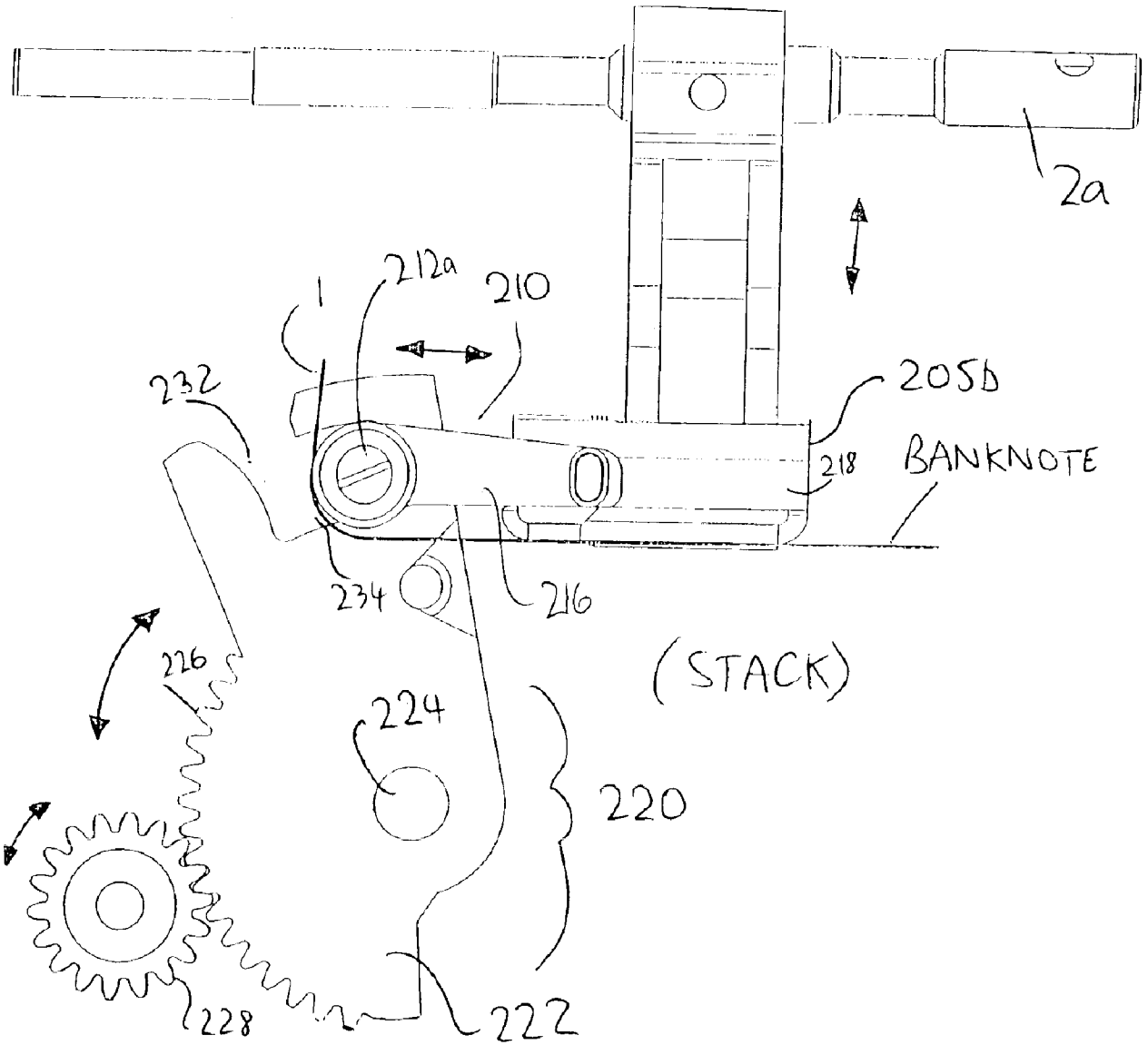
FIG. 13 is a sectional end elevation of a stacking mechanism according to a second embodiment of the invention.
Figure 16:
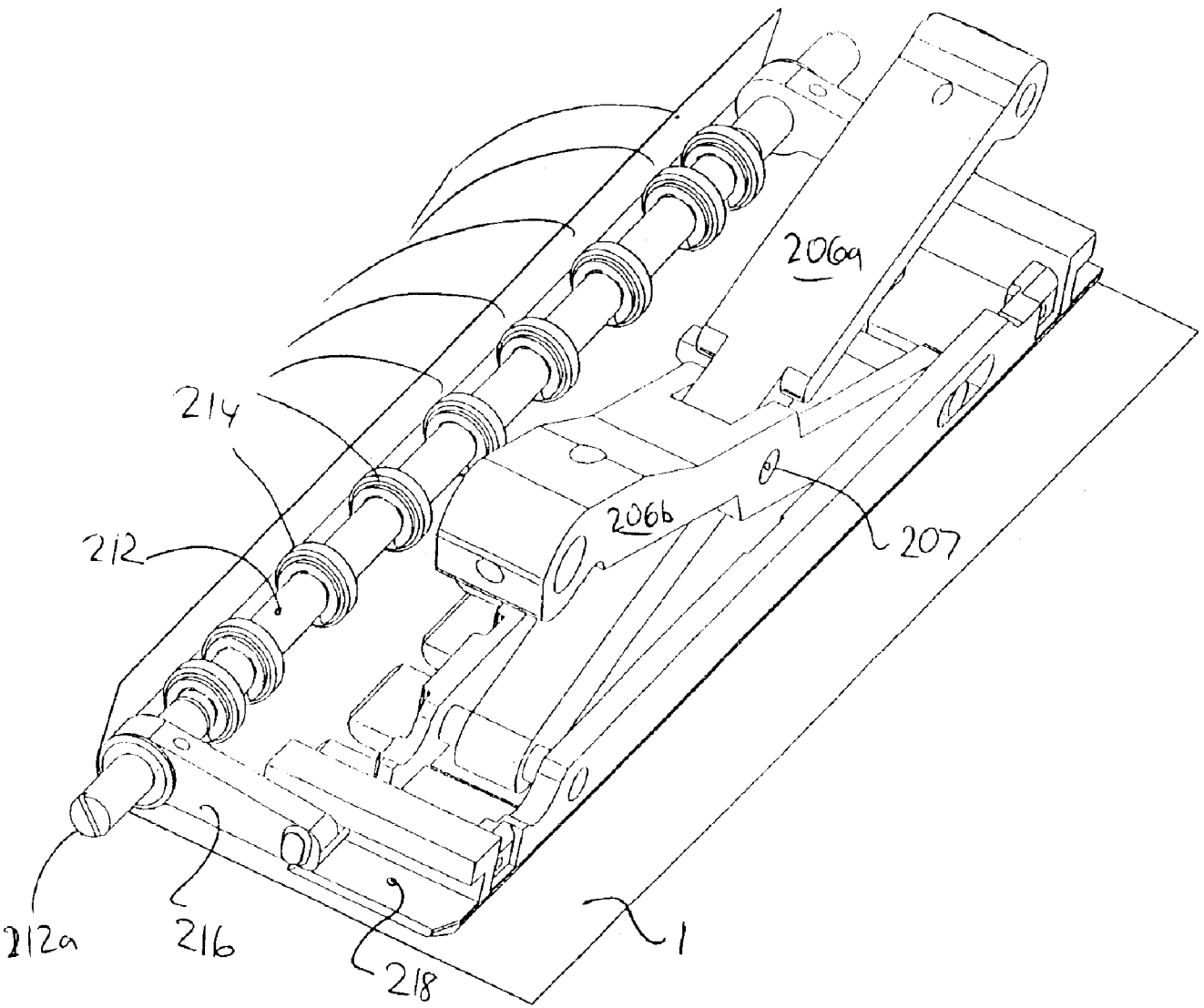

At this position, as in the first embodiment, the depth of the piston is held constant whilst lateral extension occurs. The cam tracks (not shown but as in the first embodiment) then drive the gear wheels 228 at each end to rotate, entraining the planar members 222. In the first part of the arc, the axle 212 remains stationary, sliding within the second portion 234 of the respective slot. In the second part of the arc, the axle 212 engages the rear end of each slot 234 and is then carried to the extended position, moving away from the piston 205*b*. The rollers 214 roll the banknote 1 smoothly out onto the top surface of the bill stack, pulling the side edge 1*b* of the banknote 1 down through the entry slot in the top of the cashbox to the position shown in FIGS. 13 and 16. Gravity and the resilience of the note then cause the free portions 1*a*, 1*b* of the note 1 to descend flat onto the bill stack.

Figure 17:
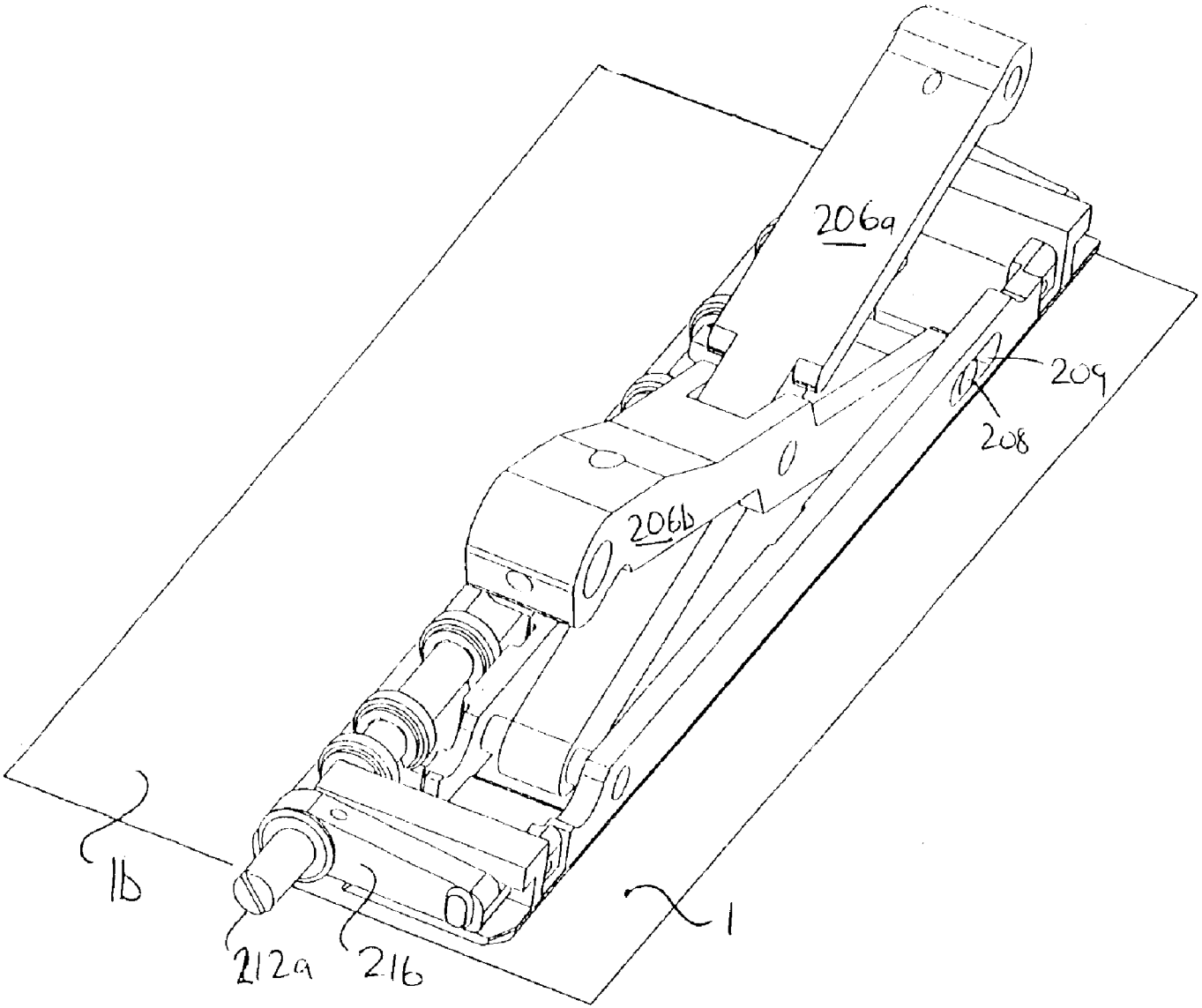
FIG. 17 corresponds to FIG. 14 and shows the piston part in a fourth position.

Next, the cam tracks (not shown) drive the gear wheels 228 to rotate in the reverse direction with the planar member 222. The side of the first portion 232 of the slot engages the axle 212, causing it to slide back in towards the piston 205*b*, rolling along the bill stack, guided by the link 216 moving along the track 218. When it is fully retracted, and as shown in FIG. 17, the axle 212 again lies vertically within the first portion 232 of the slot. The piston 205 is then retracted from the cashbox, lifting the axle 212 out of the slot at the same time, and returning to the initial position of FIG. 14 ready to stack the next note.

It will be seen that this embodiment has a number of advantages relative to the state of the art. Firstly, as in the first embodiment, the arrangement allows a narrow slot in the top of the cashbox (which assists in security of the cashbox) to be combined with a short depth of stroke of the piston (which reduces the amount of wasted space in the top of the cashbox). If the minimum depth of descent is D, and the width of the slot (and hence the bottom of the piston) is W, and the relevant dimension (in this case, the width) of the banknote is L, then the arrangement may allow a note to be stacked if $L<2(D+W)$, so that the minimum depth possible $DMin=(L/2)-W$, since in the extended state, less than D of the banknote must project at either side of the piston (to get the note entirely into the cashbox and thus prevent it extending through the slot) and the base of the piston has effectively been doubled due to the extension of the axle.

Although not necessary in this embodiment, it will be clear that the principle could further be extended to allow the piston to extend to multiples of (just less than) W, by adopting a telescopic sliding linkage in which one sliding link slides in a track carried by another and so on.

Another advantage of the present embodiment is that the actuating system for the horizontally acting axle is held in situ within the cashbox, so that the force to actuate the axle does not need to pass through the vertically extended piston. This allows a more robust and simple drive arrangement to be used, such as the rotating planar member shown. Other arrangements achieving these advantages will readily be apparent to the skilled reader.

FURTHER EMBODIMENTS

The skilled reader will understand that a banknote stacking apparatus according to the present invention may be used in various applications, particularly those where banknotes are automatically accepted and validated such as in automated vending machines and banknote changing machines.

It will be apparent from the forgoing that various modifications and variations may be employed in relation to the above-described embodiments without departing from the spirit or scope of the present invention. In particular, features of the embodiments described may be employed individually or in individual combinations without departing from the scope of the invention.

For example the skilled reader will appreciate that the present invention could be used to insert documents, such as banknotes, loosely through an aperture; thus obviating the need for any stack supporting means.

Although in a preferred embodiment the lateral extension takes place whilst the pusher is held at a constant depth portion of its stroke, it will be appreciated that the beginning and/or end of lateral extension could take place whilst the pusher is still moving vertically, provided that most of the lateral extension takes place whilst the pusher is stationary. Naturally, minor vertical movements of the-pusher such as to approximate constant depth behaviour are also within the scope of the invention.

Furthermore, the skilled reader will appreciate that by adjusting the clearance between the upper and the lower halves of the banknote transport mechanism, the present invention could be used to stack bundles of banknotes, which have been held, for example, in a temporary storage device such as an escrow.

The skilled reader will also appreciate that various modifications may be made to the drive mechanism. For example, the banknote transport mechanism may be arranged to deliver banknotes for stacking at predetermined intervals, allowing the continuous operation of the stacking mechanism. Although rollers are used in the present embodiment for the transportation of the banknotes, a belt driven transportation system could alternatively be used.

Although banknotes are described, other flat sheets having a value (for example, predetermined value payment coupons) could be employed.

Although a pair of lateral extending portions are described, a single such portion on one side could be used, the pusher then being positioned to the other side of the note. Many other variants and modifications are possible.

We claim:

1. A stacker for stacking value sheets from a sheet path into a receptacle having a sheet retaining plane, comprising a pusher operating to push a sheet with a stroke operating into the receptacle, generally transverse to the plane, and carrying one or more lateral portions proximate to its distal end, operable to extend parallel to the plane to spread a value sheet within the receptacle, and a drive system for driving the stacker, in which the drive system drives the pusher so that said stroke pushes the value sheet only partially below the plane, and the or each lateral portion starts to extend only when a portion of the sheet lies below the plane.

2. A stacker according to claim 1, in which the drive system drives the or each lateral portion to extend so that the extension takes place predominantly whilst the pusher is at the maximum extension of its stroke.

3. A stacker according to claim 1 or claim 2, in which the pusher stroke comprises an extension interval during which the pusher extends progressively into the receptacle, a holding interval during which the pusher remains at a substantially constant depth within the stacker, and a retraction interval during which the pusher retracts progressively out of the receptacle.

4. A stacker according to claim 3, in which the drive system causes the or each lateral portion to extend during the holding interval.

5. A stacker according to claim 1, in which the drive system comprises a scissors linkage operable to create said pusher stroke.

6. A stacker according to claim 1, in which the drive system comprises a scissors linkage operable to move said lateral portions.

7. A stacker according to claim 1, in which the drive system comprises a first cam surface and cam follower arrangement for said pusher, and a second cam surface and cam follower arrangement for said one or more lateral portions.

8. A stacker for stacking value sheets from a sheet path into a receptacle having a sheet retaining plane, comprising a pusher operating to push a sheet with a stroke operating into the receptacle, generally transverse to the plane, and carrying one or more lateral portions proximate to its distal end, operable to extend parallel to the plane to spread a value sheet within the receptacle, and a drive system for driving the stacker, in which the drive system comprises a scissors linkage operable to move said lateral portions.

9. A stacker according to claim 8, in which the drive system comprises a scissors linkage operable to create said pusher stroke.

10. A stacker according to claim 1, in which the or each lateral portion comprises a pair of lateral portions located at the distal end of the pusher, each comprising an outer flat surface, the flat surfaces abutting when the lateral portions are in a retracted state, and the pusher carries a scissors linkage arrangement behind the flat surfaces and extendable in a plane parallel thereto to separate the surfaces whilst extending the lateral portions.

11. A stacker comprising at least one first scissors linkage acting to extend a pusher into a cashbox, and at least one second scissors linkage acting transversely to said first to extend a lateral portion of said pusher to flatten a sheet in the cashbox.

* * * * *